US010309326B2

(12) United States Patent
Omichi et al.

(10) Patent No.: US 10,309,326 B2
(45) Date of Patent: Jun. 4, 2019

(54) EVAPORATED FUEL PROCESSING APPARATUS FOR INTERNAL COMBUSTION ENGINE

(71) Applicant: MAHLE FILTER SYSTEMS JAPAN CORPORATION, Tokyo (JP)

(72) Inventors: Junpei Omichi, Kawagoe (JP); Yuya Yamashita, Tokyo (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 0 days.

(21) Appl. No.: 15/825,468

(22) Filed: Nov. 29, 2017

(65) Prior Publication Data

US 2018/0171901 A1 Jun. 21, 2018

(30) Foreign Application Priority Data

Dec. 15, 2016 (JP) ..... 2016-242867

(51) Int. Cl.
*F02D 41/00* (2006.01)
*F02M 25/08* (2006.01)

(52) U.S. Cl.
CPC ..... *F02D 41/0032* (2013.01); *F02M 25/089* (2013.01); *F02M 25/0818* (2013.01); *F02M 25/0836* (2013.01); *F02M 25/0872* (2013.01)

(58) Field of Classification Search
CPC ..... F02D 51/00; F02D 51/0032; F02M 25/08; F02M 25/0818; F02M 25/0836; F02M 25/0872; F02M 25/089; F02M 33/02
USPC ..... 123/495, 497, 508–510, 516–520
See application file for complete search history.

(56) References Cited

U.S. PATENT DOCUMENTS 5,553,577 A * 9/1996 Denz ..... B60K 15/03504 123/198 D
5,813,427 A * 9/1998 Huh ..... F02M 25/0854 123/198 D
5,975,062 A * 11/1999 Bonse ..... F02M 25/0818 123/519
5,992,396 A * 11/1999 Krimmer ..... B60K 15/03504 123/519

(Continued)

FOREIGN PATENT DOCUMENTS

JP 2007-332855 A 12/2007

*Primary Examiner* — John Kwon
*Assistant Examiner* — Johnny H Hoang
(74) *Attorney, Agent, or Firm* — Foley & Lardner LLP

(57) ABSTRACT

Disclosed is an evaporated fuel processing apparatus for an internal combustion engine including: a canister; and a purge passage supplying purge gas including evaporated fuel separated from the canister to an intake system therethrough; characterized in that the evaporated fuel processing apparatus further comprises a pulsation pump supplying the purge gas to the intake system by using a pumping action responding to intake pulsation generated in an intake passage of the internal combustion engine. The pulsation pump includes: a first chamber; a communication passage communicating with the first chamber and the intake passage; an elastic body being deformed depending on pressure fluctuation of the first chamber; a second chamber formed so as to surround the elastic body; a suction port provided with a check valve allowing inflow of gas into the second chamber, and a discharge port provided with a check valve allowing outflow of gas from the second chamber.

5 Claims, 12 Drawing Sheets

(56) References Cited

U.S. PATENT DOCUMENTS

| | | | | |
|---|---|---|---|---|
| 6,634,343 | B2 * | 10/2003 | Kano | F02M 25/0818 123/520 |
| 2005/0092305 | A1 * | 5/2005 | Rado | F02M 25/0836 123/518 |
| 2005/0178368 | A1 * | 8/2005 | Donahue | F02M 35/10222 123/520 |

* cited by examiner

EVAPORATED FUEL PROCESSING APPARATUS FOR INTERNAL COMBUSTION ENGINE

TECHNICAL FIELD

The present invention relates to an evaporated fuel processing apparatus for an internal combustion engine, which processes evaporated fuel in a fuel tank.

BACKGROUND OF THE INVENTION

In an internal combustion engine for an automobile where gasoline is used as fuel, a canister has been generally used as an evaporated fuel processing device in order to prevent evaporated fuel in a fuel tank from being discharged into the atmosphere.

However, in an internal combustion engine being difficult to generate negative pressure in an intake system like an internal combustion engine for an automobile using a supercharger, it is difficult to restore a canister by separating evaporated fuel adsorbed to the canister. Therefore, Patent Document 1 (JP 2007-332855 A) has disclosed an art: negative pressure is generated in an ejector by using supercharging pressure depending on a supercharger, and a purge in the canister is conducted by the negative pressure.

SUMMARY OF THE INVENTION

However, in the above-mentioned art that negative pressure is forcibly generated by the ejector using supercharging pressure, in case that the supercharging pressure is low, it is difficult to generate a sufficient negative pressure. Therefore, it is also difficult to secure a sufficient flow rate of purge gas. Especially, in an internal combustion engine subjected to down-sizing by using a supercharger, supercharging pressure is relatively low, and the flow rate of the purge gas tends to be insufficient due to influences of pressure loss in the ejector itself and pressure loss in a purge control valve which controls the flow rate of the purge gas. Furthermore, a general ejector has a mechanism to simply generate negative pressure with respect to a pressurizing force, so it is difficult in principal to sufficiently increase negative pressure to be generated.

Therefore, it is an object of the present invention to provide a new evaporated fuel processing apparatus for an internal combustion engine in which to sufficiently secure a flow rate of purge gas is possible regardless of operation conditions of an engine such as supercharging pressure, engine rotation speed, etc.

According to one aspect of the present invention, an evaporated fuel processing apparatus for an internal combustion engine comprising:

- a canister to which evaporated fuel in a fuel tank is adsorbed temporarily, and
- a purge passage that supplies a purge gas including the evaporated fuel separated from the canister to an intake system of the internal combustion engine therethrough, is characterized in that the evaporated fuel processing apparatus further comprises:
- a pulsation pump that supplies the purge gas to the intake system by using a pumping action responding to intake pulsation generated in a intake passage of the internal combustion engine,
  - the pulsation pump comprising:
    - a first chamber,

- a communication passage communicating with the first chamber and the intake passage,
- an elastic body constituting at least a part of a wall part sealing up the first chamber and being deformed depending on pressure fluctuation of the first chamber,
- a second chamber formed so as to surround the elastic body,
- a suction port provided with a check valve allowing inflow of gas into the second chamber, and
- a discharge port provided with a check valve allowing outflow of gas from the second chamber.

DETAILED DESCRIPTION OF THE INVENTION

According to the present invention, a pulsation pump using intake pulsation unavoidably generated during operation of an internal combustion engine is used. A purge gas is supplied to an intake system by a pumping action of the pulsation pump, so it becomes easy to secure a flow rate of the purge gas.

Therefore, even in an internal combustion engine such as an internal combustion engine provided with a turbo supercharger, which is difficult to secure the flow rate of the purge gas by using negative pressure because of not generating negative pressure in the intake system depending on an operation condition of the engine, it is possible to sufficiently secure the flow rate of the purge gas.

As one preferable aspect of the present invention, the purge passage is provided with an ejector to carry the purge gas, and thereby the evaporated fuel processing apparatus is configured so that air sucked from the suction port is supplied to the ejector from the discharge port as an operation gas.

As another preferable aspect of the present invention, the suction port is connected to the purge passage, and thereby the evaporated fuel processing apparatus is configured so that the purge gas discharged from the discharge port is supplied to the intake system.

Furthermore, the present invention is particularly effective for an internal combustion engine in which negative pressure is difficult to be generated in an intake system. Therefore, as another preferable aspect of the present invention, the evaporated fuel processing apparatus includes a compressor of a supercharger to pressurize an intake air supplied to the internal combustion engine.

Hereinafter, the present invention will be explained in detail, based on illustrated embodiments.

Figure 1:
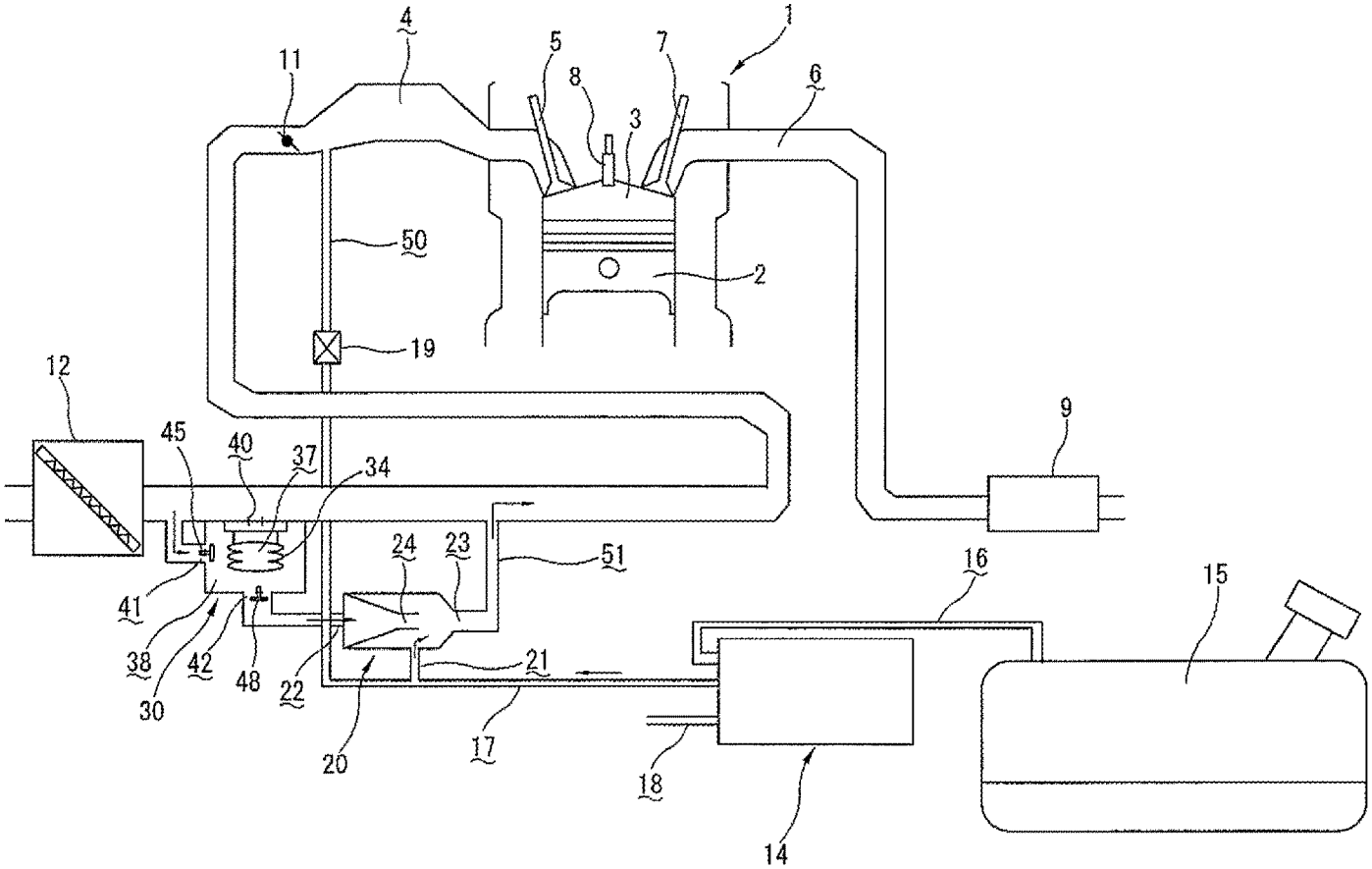
FIG. 1 is a configuration diagram simply illustrating an evaporated fuel processing apparatus for an internal combustion engine according to a first embodiment of the present invention.

FIG. 1 is a configuration diagram simply illustrating an evaporated fuel processing apparatus for an internal combustion engine according to a first embodiment of the present invention. A combustion chamber 3 is defined on an upper part of a piston 2 of the internal combustion engine 1. To the combustion chamber 3, an intake passage 4 is connected through an intake valve 5, and an exhaust passage 6 is connected through an exhaust valve 7. Furthermore, a fuel injection valve 8 is provided in the combustion chamber 3. In the exhaust passage 6, a muffler 9 for silencing is provided. In the intake passage 4, a throttle valve 11 adjusting the volume of intake air is provided. In an upstream side from the throttle valve 11, an air cleaner 12 for removing extraneous materials and dust is provided.

A canister 14 is one of main parts of the evaporated fuel processing apparatus. As is well known, the canister 14 is can-shaped, wherein an inside of the canister 14 is filled with an adsorbing agent such as activated carbon. Furthermore, the canister 14 has a vapor passage 16 connected to a fuel tank 15; a purge passage 17 connected to the intake system; and an atmospheric passage 18 opening to the atmosphere.

At the time of stopping of the engine, evaporated fuel generated in the fuel tank 15 is introduced into the canister 14 through the vapor passage 16, the evaporated fuel is adsorbed to the adsorbing agent, and clean air, in which the evaporated fuel has been removed, is discharged to the atmosphere through the atmospheric passage 18. During the engine operation, first, the air is supplied to the inside of the canister 14 through the atmospheric passage 18 by a suction action due to negative pressure generated in the intake system. By a flow of the air, purge gas including the evaporated fuel separated from the adsorbing agent in the canister 14 is supplied to the intake system of the internal combustion engine through the purge passage 17. Furthermore, the purge gas is sent to the combustion chamber 3 of the internal combustion engine 1 through the intake passage 4, and it is burned and removed there. Thereby, the canister 14 is restored.

The purge passage 17 is a passage to return the purge gas to the intake system from the canister 14. One end of the purge passage 17 is connected to the canister 14, and the other end of the purge passage 17 is connected to the intake passage 4 which is located in a downstream side from the throttle valve 11. The purge passage 17 is provided with a purge control valve 19, which is an electromagnetic valve to adjust the flow rate of the purge gas. Operation of the purge control valve 19 is controlled by a control section (not shown), according to the operation condition of the engine as with the throttle valve 11.

Furthermore, the purge passage 17 branches on its way and is connected to a negative pressure port 21 of an ejector 20 for carrying the purge gas. As is well known, the ejector 20 is provided with a throttled part 24 in the middle of the flow of operation gas from an inlet port 22 toward an outlet port 23. The throttled part 24 is where a flow passage cross-sectional area is made small. Furthermore, the ejector 20 is configured as follows: the purge gas is sucked from the negative pressure port 21 by negative pressure generated when the operation gas passes through the throttled part 24, and the purge gas is supplied and carried to the intake passage 4 through the outlet port 23.

As a pump to supply a pressurized operation gas to the inlet port 22 of the ejector 20, a pulsation pump 30 which is a main part of the present embodiment is used.

Figure 2:
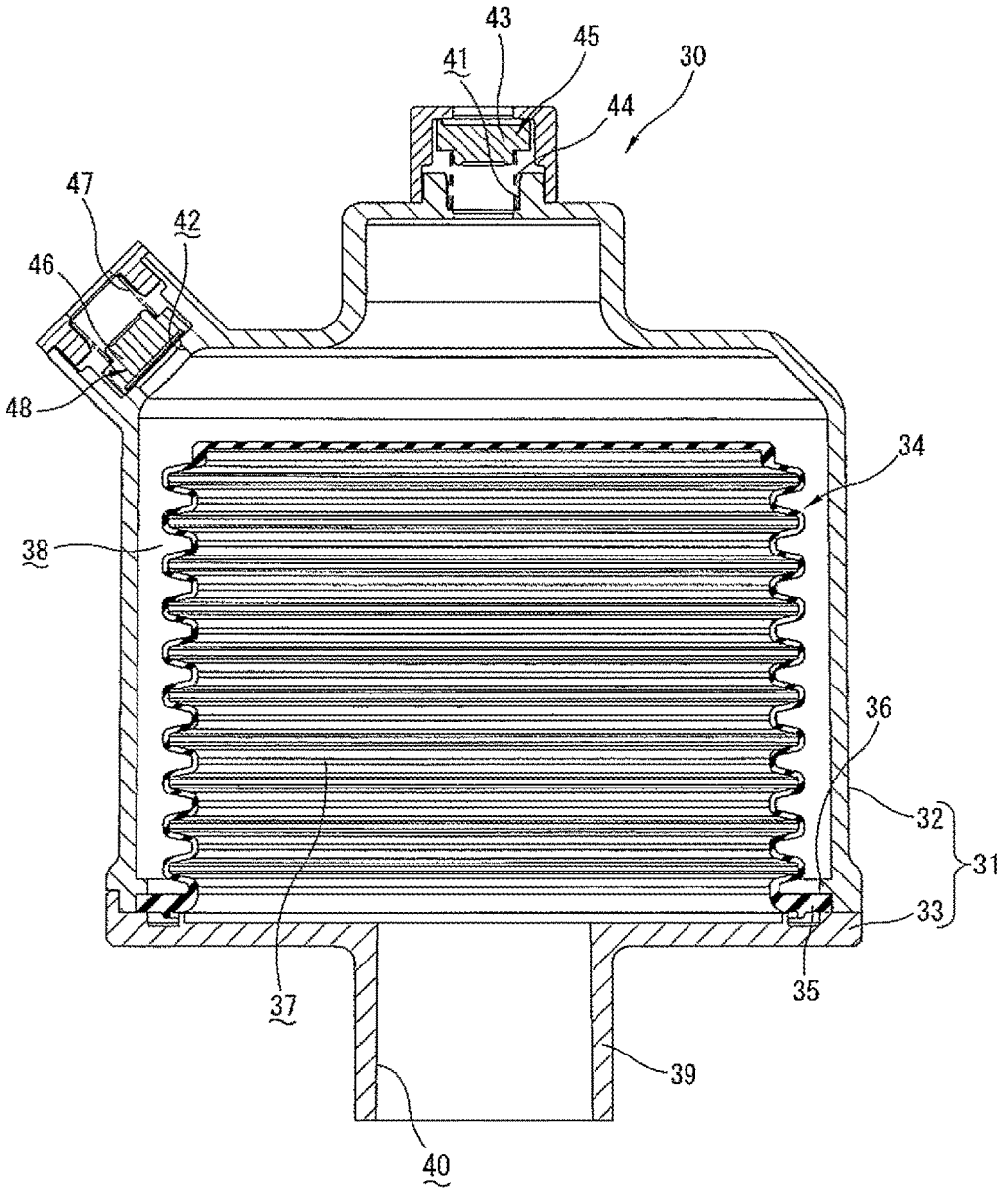
FIG. 2 is a cross-section view of a pulsation pump according to the first embodiment.
Figure 3:
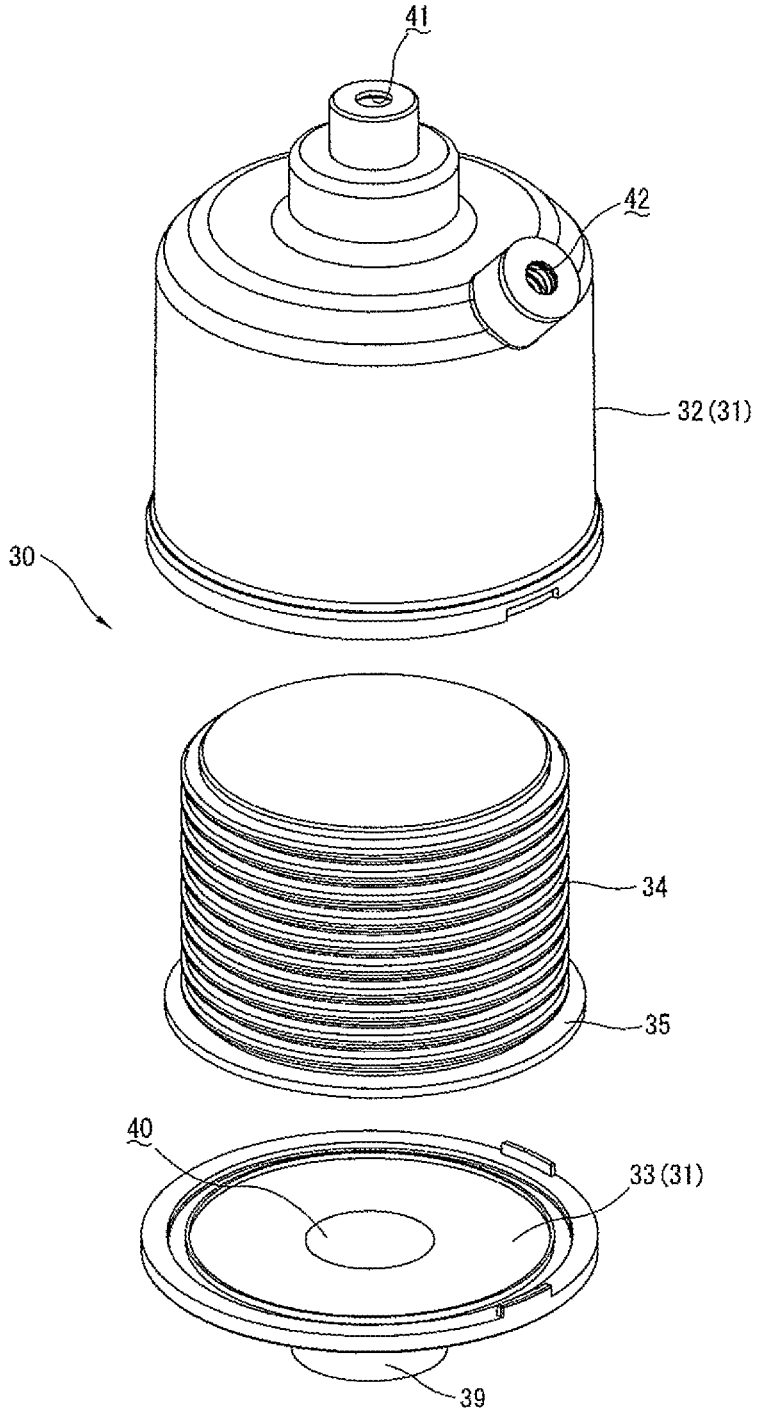
FIG. 3 is an exploded perspective view of the pulsation pump according to the first embodiment.

The pulsation pump 30 is what uses a pumping action responding to intake pulsation unavoidably generated in the intake passage 4 during operation of an internal combustion engine. Concretely, as shown in FIG. 2 and FIG. 3, the pulsation pump 30 includes a case 31 being can-shaped. The case 31 is composed of a case body 32 and a cover 33, which are made of synthetic resin. The case body 32 is cylinder-shaped, and its one end is opened. The cover 33 is connected to the open end of the case body 32 so as to seal up the open end.

An elastic body 34, which is made of rubber, is contained in the inside of the case 31 so as to be surrounded. As to the elastic body 34, its base end is opened, and its top end is sealed, that is, the elastic body is bottomed cylinder-shaped. A peripheral wall of the elastic body 34 is bent-formed into a bellows shape to be deformable in an axial direction (vertical direction in FIG. 3). A flange part 35 extending outwardly in a radial direction is provided at the base end of the elastic body 34. The flange part 35 is held between the cover 33 and a fitting part 36 of the case body 32, and thereby the elastic body 34 is held in the case 31.

An internal space of the elastic body 34 shut by the wall part of the elastic body 34 is defined as a first chamber 37. Furthermore, a space between the elastic body 34 and the case 31 is defined as a second chamber 38. That is, the internal space of the case 31 is air-tightly partitioned into the first chamber 37 and the second chamber 38.

A cylindrical communication pipe 39 is formed in a center part of the cover 33. The first chamber 37 and the intake passage 4 (More concretely, a position of the intake passage 4 which is in a downstream side from the air cleaner 12 and in an upstream side from the throttle valve 11) are communicated with each other by a communication passage 40 passing through the communication pipe 39.

An upper wall part of the case body 32 is provided with a suction port 41 and a discharge port 42. The suction port 41 is provided with a suction valve 45 as a check valve including a spring 44 which energizes a valve body 43 in a valve close direction (direction opposite to a flow of sucked gas; upward direction in FIG. 2). The suction valve 45 allows inflow of gas into the second chamber 38 and prevents outflow of gas from the second chamber 38. Similarly, the discharge port 42 is provided with a discharge valve 48 as a check valve including a spring 47 which energizes a valve body 46 in a valve close direction (direction opposite to a flow of discharged gas; obliquely downward direction in FIG. 2). The discharge valve 48 allows outflow of gas from the second chamber 38 and prevents inflow of gas into the second chamber 38.

FIG. 1 is referred again. In this first embodiment, the suction port 41 of the pulsation pump 30 is connected to the intake passage 4 (in more detail, a position of the intake passage 4 which is in a downstream side from the air cleaner 12 and in an upstream side from the throttle valve 11). Furthermore, the discharge port 42 is connected to the inlet port 22 of the ejector 20.

According to the above structure, in an operation condition where negative pressure is generated in a downstream side from the throttle valve 11 during operation of the internal combustion engine, the purge gas is supplied to the intake passage 4 in the downstream side from the throttle valve 11 through the purge passage 17, and the flow rate of the purge gas is controlled by the purge control valve 19.

Furthermore, during operation of the internal combustion engine, intake pulsation is unavoidably generated in the intake passage 4. The intake pulsation affects the first chamber 37 communicating with the intake passage 4 through the communication passage 40. Therefore, by pressure fluctuation in the first chamber 37 due to the intake pulsation, the elastic body 34, which defines the first chamber 37, is elastically deformed in an axial direction. The elastic deformation of the elastic body 34 changes pressure of the second chamber 38 in the case 31. Thereby, the gas flows into the second chamber 38 from the suction port 41 through the suction valve 45, and the gas is discharged from the second chamber 38 into the discharge port 42 through the discharge valve 48. The gas discharged into the discharge port 42 is introduced into the inlet port 22 of the ejector 20 and pressurized there. Such a pumping action of the pulsation pump 30 generates pressure difference between the inlet port 22 and the outlet port 23 in the ejector 20. The pressure difference makes an operation gas flow from the inlet port 22 to the outlet port 23, and a venturi effect when the operation gas passes through the throttled part 24 decreases pressure. Thereby, negative pressure is generated. By the negative pressure, the purge gas is sucked through the negative pressure port 21 and carried to the intake passage 4 through the outlet port 23. In this way; the sequential passage of the purge gas, which branches from the purge passage 17 and continues to the intake passage 4 via the negative pressure port 21 and the outlet port 23 of the ejector 20, constitutes a pulsation purge line 51 to carry the purge gas to the intake system, apart from a main purge line 50 to carry the purge gas to the downstream side from the throttle valve 11 through the purge passage 17.

In the present embodiment described above, the apparatus is configured to carry the purge gas to the intake system by using the pulsation pump 30 using intake pulsation, so it is possible to sufficiently secure a flow rate of the purge gas even in the operation condition where it is difficult to supply the purge gas to the downstream side from the throttle valve 11 through the purge passage 17 due to a small negative pressure of the downstream side from the throttle valve 11. Therefore, in an internal combustion engine where negative pressure in the downstream side from the throttle valve 11 is small, such as an internal combustion engine provided with a supercharger; and an internal combustion engine capable of adjusting the amount of intake air by a variable valve system, it is possible to sufficiently secure the flow rate of the purge gas.

Figure 4:
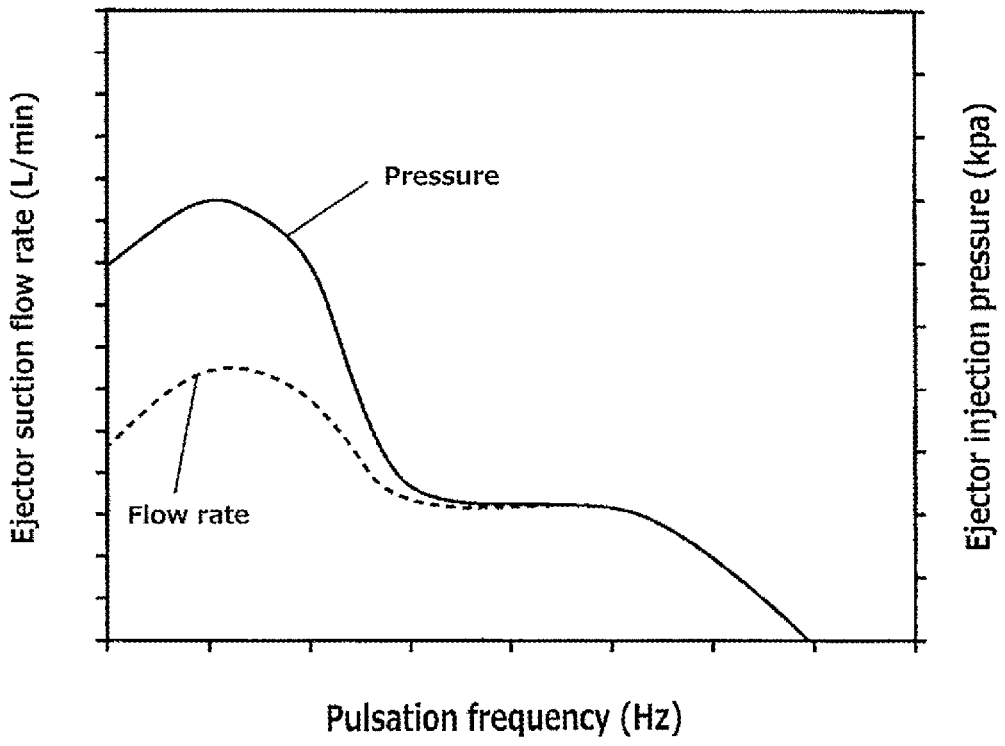
FIG. 4 is a characteristic graph showing characteristics in a vicinity of an inlet port of an ejector according to the first embodiment.

FIG. 4 shows test results of the flow rate and the pressure to affect the inlet port 22 of the ejector 20 in case of using an elastic body 34 having a diameter of 65 mm and a length of 80 mm. As shown in FIG. 4, a structure of the elastic body 34 is adjusted/set so that the oscillation (amplitude) in an axial direction of the elastic body 34 gets a peak in a low speed operation region where oscillation of the intake pulsation causes a low frequency. Thereby, it is possible to sufficiently secure the purge gas even in a low frequency region (low speed operation region) where negative pressure is difficult to be generated in a downstream side from a throttle valve 11.

In the embodiments explained below, parts different from the previously explained embodiment will mainly be explained. The same components as the previously explained embodiment are given the same reference numerals, and an overlap explanation will properly be omitted.

Figure 5:
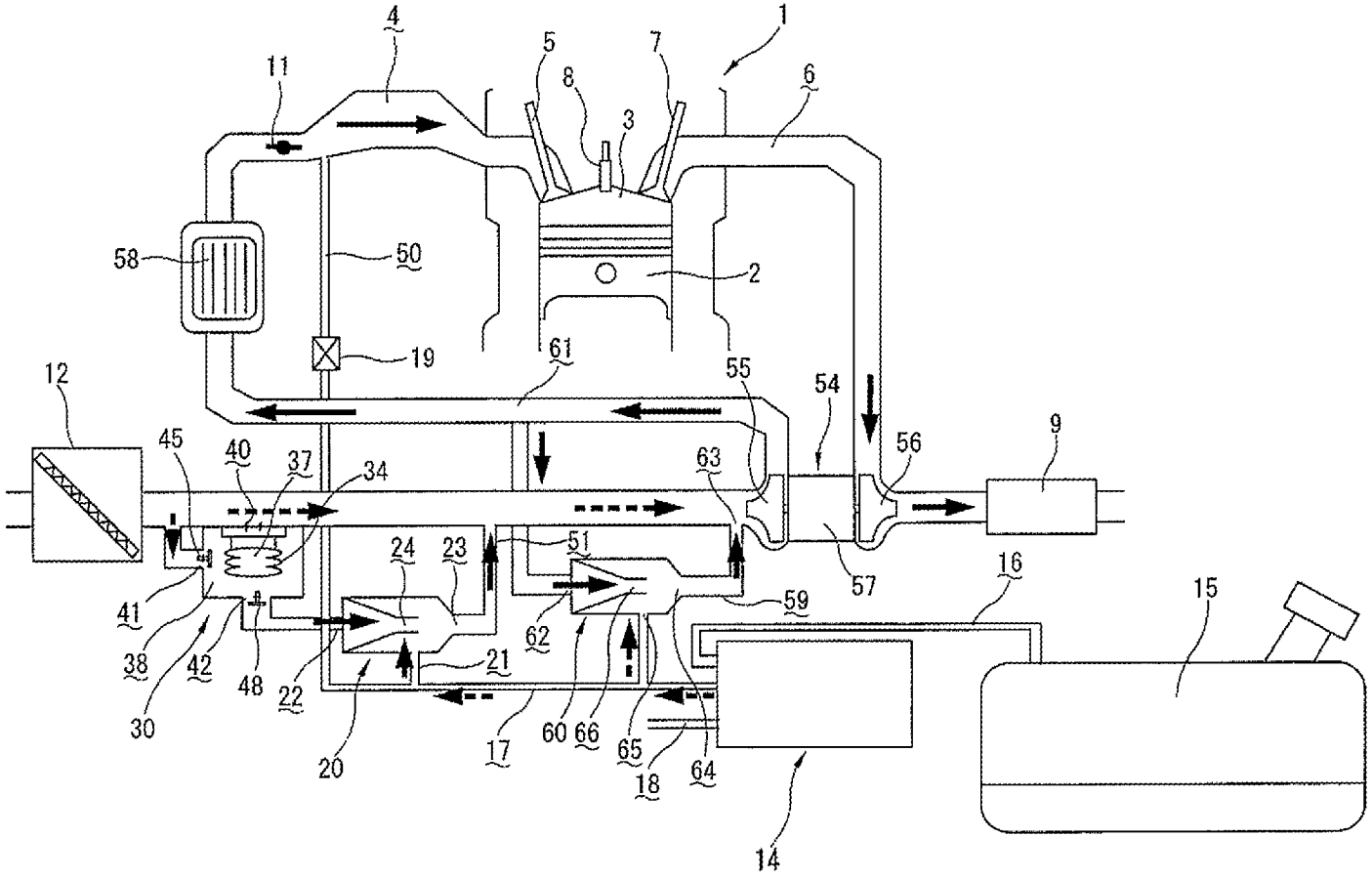
FIG. 5 is a configuration diagram simply illustrating a gas flow in supercharging in an evaporated fuel processing apparatus for an internal combustion engine according to a second embodiment of the present invention.
Figure 6:
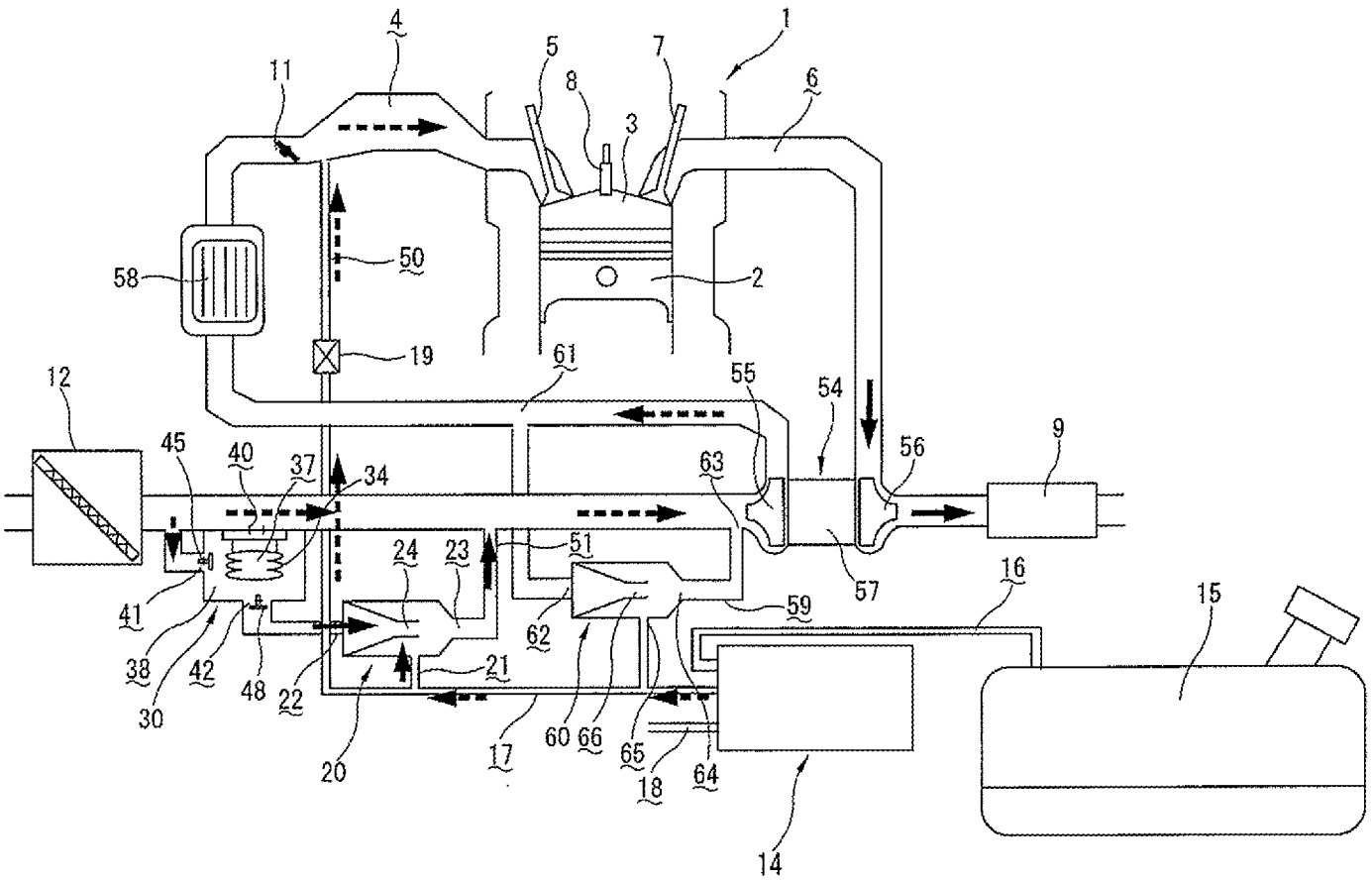
FIG. 6 is a configuration diagram simply illustrating a gas flow in non-supercharging in the evaporated fuel processing apparatus for an internal combustion engine according to the second embodiment.

FIG. 5 and FIG. 6 show a second embodiment of the present invention. In the second embodiment, a turbocharger 54 to supercharge intake air in an internal combustion engine is provided. As is well known, the turbocharger 54 is provided with a compressor 55 to supercharge the intake air; and a turbine 56 rotationally driven by exhaust gas. The compressor 55 and the turbine 56 are arranged back to back with each other on a shaft 57. The intake passage 4 is provided with an intercooler 58 in a downstream side from the compressor 55. The intercooler 58 cools supercharged air. Furthermore, the intake passage 4 is provided with an ejector 60 for supercharging in addition to the ejector 20. The ejector 60 for supercharging includes an inlet port 62, an outlet port 64, and a negative pressure port 65. The inlet port 62 is connected to a downstream side part 61 from the compressor 55 in the intake passage 4. The outlet port 64 is connected to an upstream side part 63 from than the compressor 55 in the intake passage 4. The negative pressure port 65 is connected to the purge passage 17.

FIG. 5 shows a flow of gas including the purge gas in supercharging. Solid arrows show a flow of positive pressure. Broken arrows show a flow of negative pressure. As shown in FIG. 5, negative pressure is not generated in the downstream side of the throttle valve 11 in supercharging, so the purge gas is not suppled to the downstream side of the throttle valve 11 through the purge passage 17. On the other hand, in supercharging, pressure difference is generated between the upstream side part 63 and the downstream side part 61 respectively from the compressor 55 in the intake passage 4. The pressure difference generates a flow of operation gas toward the outlet port 64 from the inlet port 62 of the ejector 60 for supercharging. Furthermore, negative pressure is generated when the operation gas passes through a throttled part 66. By the negative pressure, the purge gas is sucked from the negative pressure port 65 and supplied to the upstream side part 63 from the compressor 55 in the intake passage 4 through the outlet port 64. In this way, the flow of the purge gas, which branches from the purge passage 17 and continues to the intake system via the negative pressure port 65 and the outlet port 64 of the ejector 60 for supercharging, constitutes a supercharging purge line 59 to carry the purge gas to the intake system, apart from a main purge line 50 of the purge passage 17 and the pulsation purge line 51.

Moreover, as with the first embodiment, the purge gas is further supplied to the intake system through the pulsation purge line 51 by the pumping action of the pulsation pump 30 using intake pulsation unavoidably generated during operation the internal combustion engine.

FIG. 6 shows a flow of gas including the purge gas in non-supercharging. As shown in FIG. 6, negative pressure is generated in the downstream side of the throttle valve 11 in non-supercharging, so the purge gas is provided for the downstream side of the throttle valve 11 through the purge passage 17. On the other hand, in non-supercharging, differential pressure is not generated between the upstream side part 63 and the downstream side part 61 respectively from the compressor 55 in the intake passage 4. Therefore, the ejector 60 for supercharging doesn't operate, and to provide the purge gas is not supplied by the supercharging purge line 59.

Furthermore, the intake pulsation occurs also in non-supercharging, so the pumping action of the pulsation pump 30 using the intake pulsation supplies the purge gas to the intake system through the pulsation purge line 51 as with in supercharging.

Figure 7:
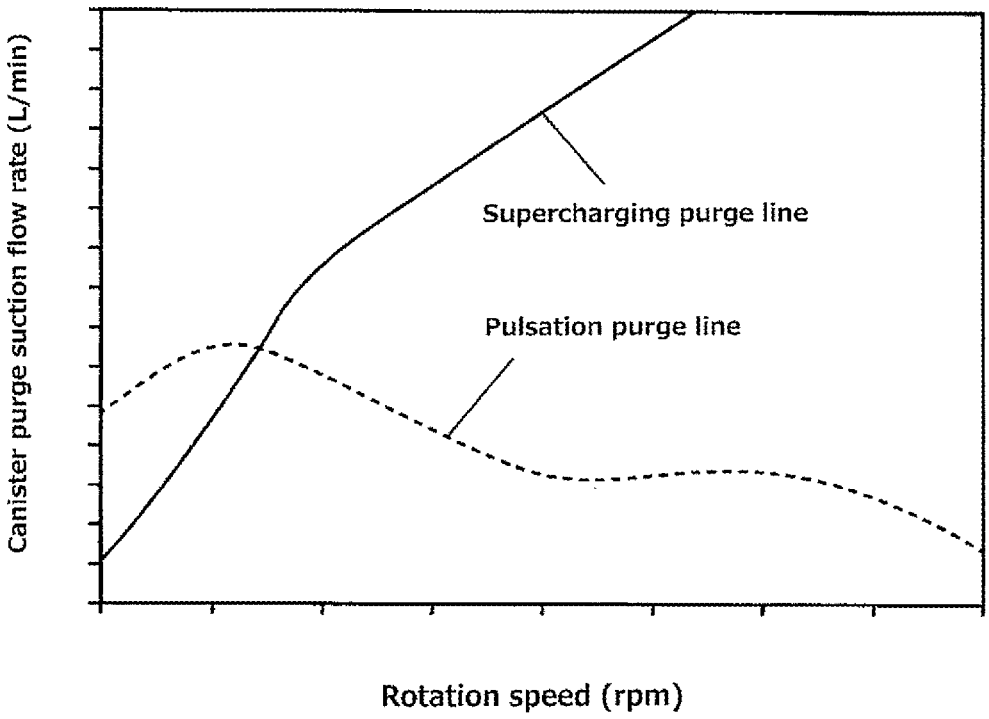
FIG. 7 is a characteristic graph showing flow rates of purge in a supercharging purge line and a pulsation purge line.

FIG. 7 is a characteristic graph showing a relation between the engine rotation speed and the purge flow rate. A solid line in FIG. 7 represents a purge flow rate obtained through the supercharging purge line 59. A broken line in FIG. 7 represents a purge flow rate obtained through the pulsation purge line 51. If trying to secure the purge flow rate by only the ejector 60 for supercharging without the pulsation pump 30 and the ejector 20, the purge flow rate lacks in a low speed operation region (low frequency region) where supercharging pressure is difficult to be obtained. In contrast, if using the pulsation pump 30 and the ejector 20 in addition to the ejector 60 for supercharging, the purge flow rate obtained through the pulsation purge line 51 (represented by the broken line) is added to the characteristic represented by the solid line in FIG. 7. Therefore, it is possible to sufficiently secure the purge flow rate even in the low speed operation region (low frequency region) where the purge flow rate tends to lack.

Figure 8:
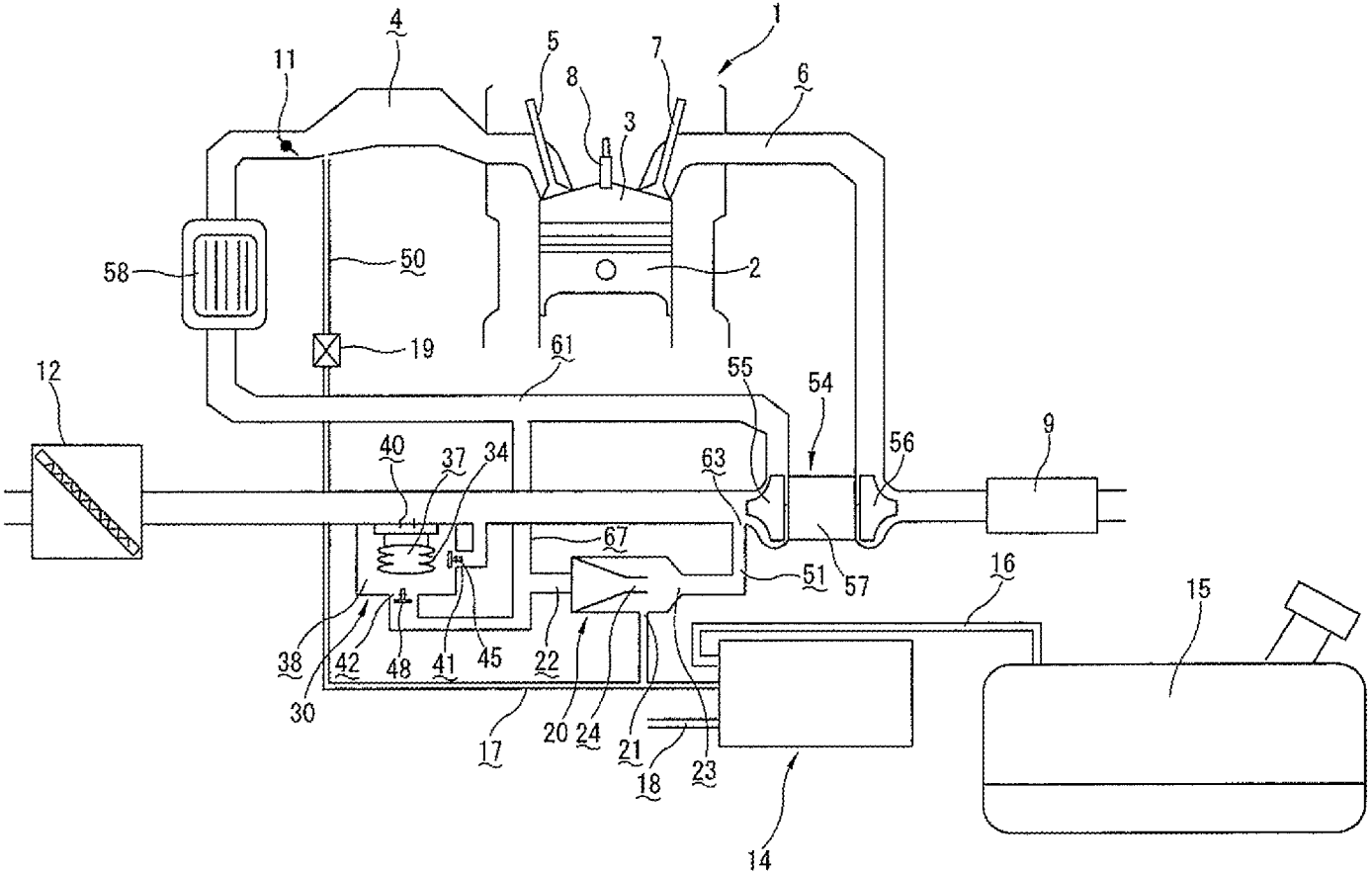
FIG. 8 is a configuration diagram simply illustrating an evaporated fuel processing apparatus for an internal combustion engine according to a third embodiment of the present invention.

FIG. 8 shows a third embodiment of the present invention. In the third embodiment, a gas line is shared so that the ejector 20 fulfills the function of the ejector 60 for supercharging of the second embodiment. That is, the inlet port 22 of the ejector 20 is connected to both of the downstream side part 61 from the compressor 55 in the intake passage 4 and the discharge port 42 of the pulsation pump 30 by a shared passage 67 where the gas line is shared. Therefore, to the inlet port 22 of the ejector 20, pressurized operation gas is always supplied from a discharge port 42 side of the pulsation pump 30. Furthermore, in supercharging, supercharged operation gas is supplied to the inlet port 22 of the ejector 20 also from the upstream part 63 of the compressor 55 in the intake passage 4.

According to the third embodiment, the same effect as the second embodiment can be obtained. Furthermore, the functions of the ejector 20 and the ejector 60 for supercharging are shared by one ejector 20. Therefore, it is possible to reduce the number of parts and to conduct shortening of the passage pipe by the sharing.

Figure 9:
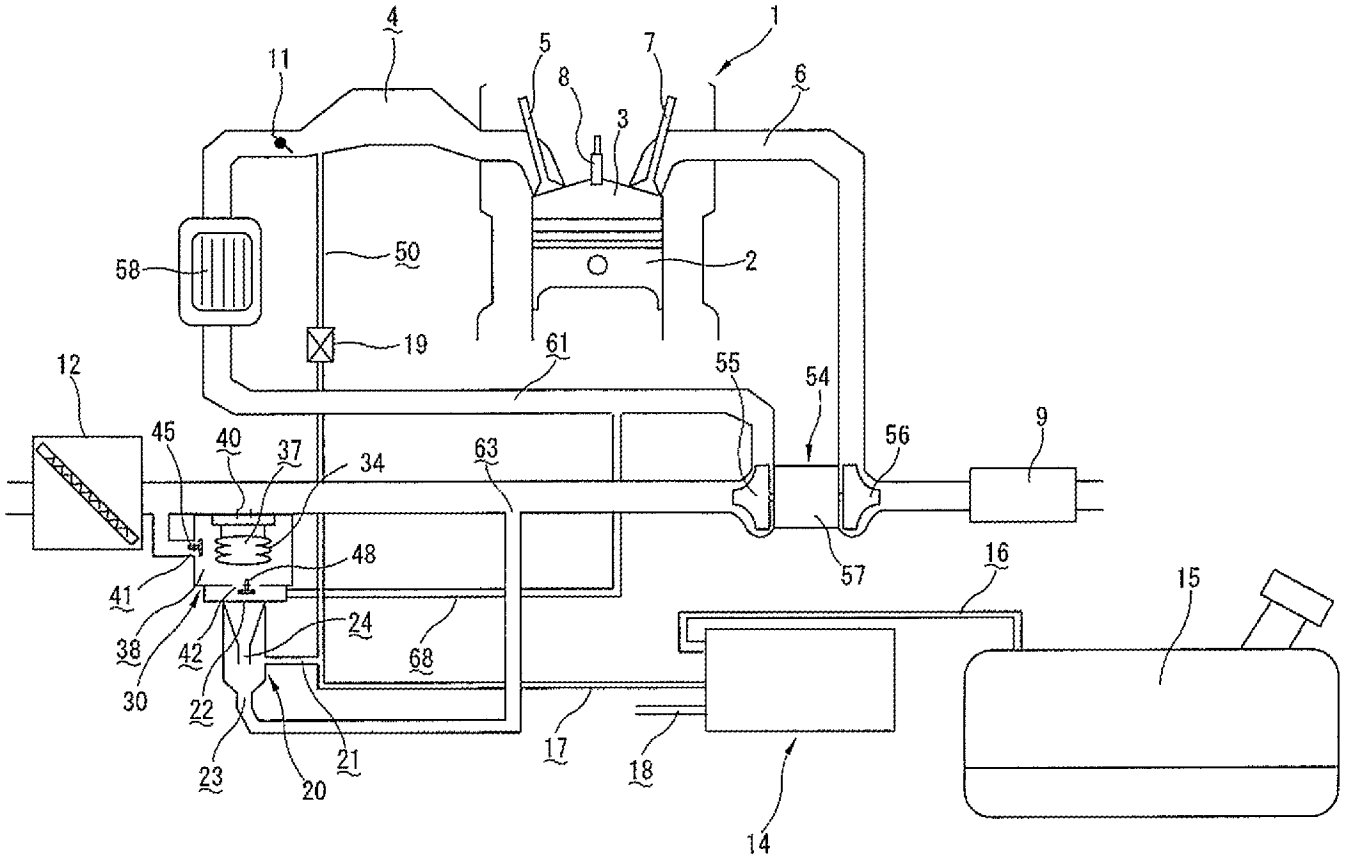
FIG. 9 is a configuration diagram simply illustrating an evaporated fuel processing apparatus for an internal combustion engine according to a fourth embodiment of the present invention.

FIG. 9 shows a fourth embodiment of the present invention. In the fourth embodiment, the pulsation pump 30 and the ejector 20 are integrally formed as compared with the third embodiment. That is, the inlet port 22 side of the ejector 20 is directly installed in the discharge port 42 side of the pulsation pump 30, and a passage therebetween is omitted. Thereby, it is possible to fulfill a further simplification and a shortening of the passage. Furthermore, instead of the shared passage 67, a supercharging passage 68 is installed. The supercharging passage 68 connects the downstream side part 61 from the compressor 55 in the intake passage 4 to the inlet port 22 of the ejector 20.

Figure 10:
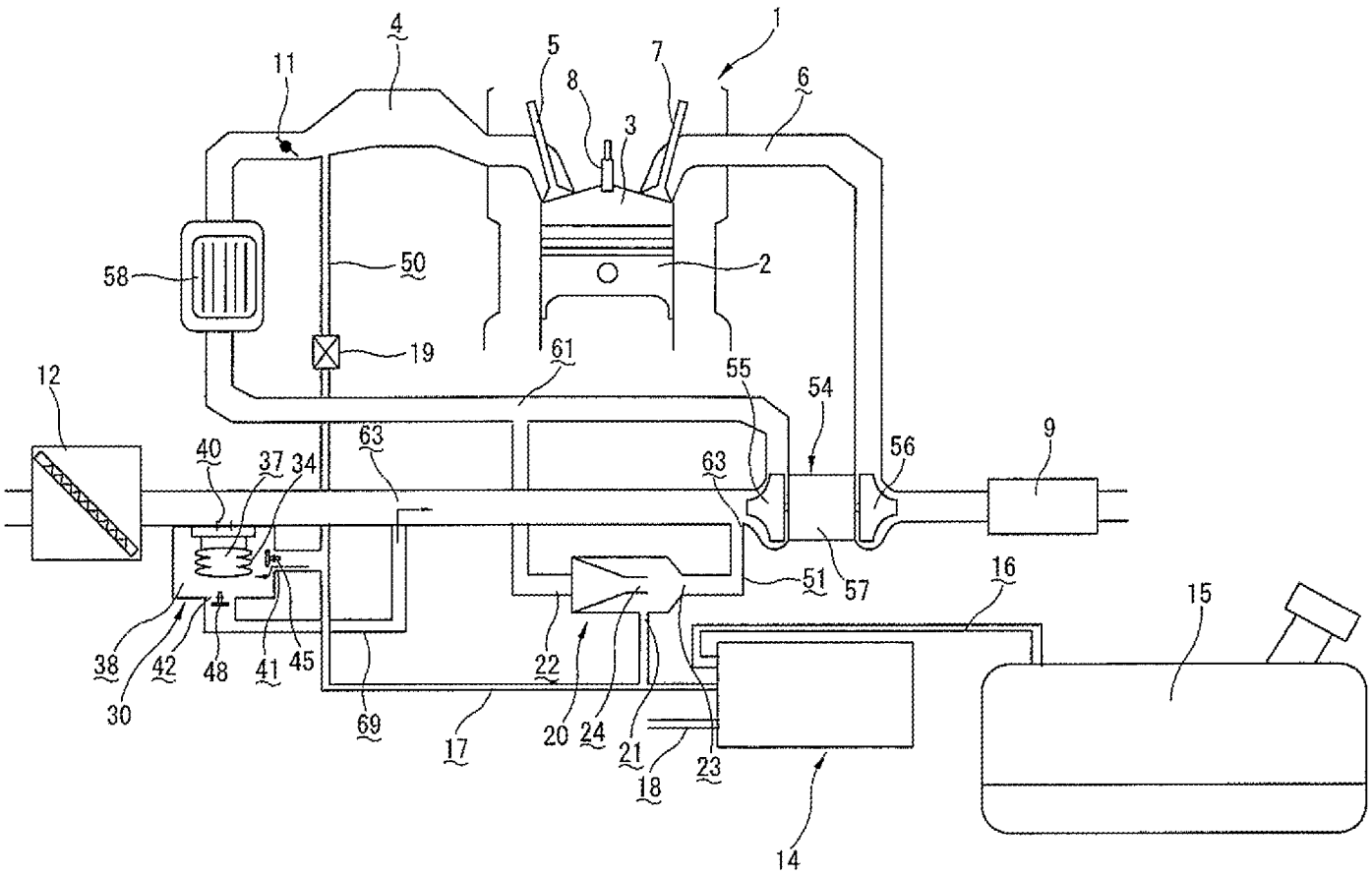
FIG. 10 is a configuration diagram simply illustrating an evaporated fuel processing apparatus for an internal combustion engine according to a fifth embodiment of the present invention.

FIG. 10 shows a fifth embodiment of the present invention. In the fifth embodiment, the ejector (20) connected to the discharge port 42 of the pulsation pump 30 is omitted as compared with the second embodiment.

Furthermore, the suction port 41 of the pulsation pump 30 is connected to the purge passage 17. The discharge port 42 of the pulsation pump 30 is connected to the upstream side part 63 from the compressor 55 in the intake passage 4. According to such a structure, as shown by the arrow in FIG. 10, the purge gas sucked through the suction port 41 of the pulsation pump 30 by the pumping action of the pulsation pump 30 using intake pulsation is discharged from the discharge port 42 and supplied to the upstream part 63 from the compressor 55 in the intake passage 4. In this way, the flow of the purge gas, which branches from the purge passage 17 and continues to the intake system via the suction port 41 and the discharge port 42 of the pulsation pump 30, constitutes a pulsation purge line 69 to supply the purge gas to the intake system, apart from the main purge line 50.

According to the fifth embodiment, the ejector (20) is omitted, nevertheless, as with the second embodiment, it is possible to surely supply the purge gas to the intake system by using the pumping action of the pulsation pump 30 even in an operation condition where negative pressure is not generated in the downstream side of the throttle valve 11.

Figure 11:
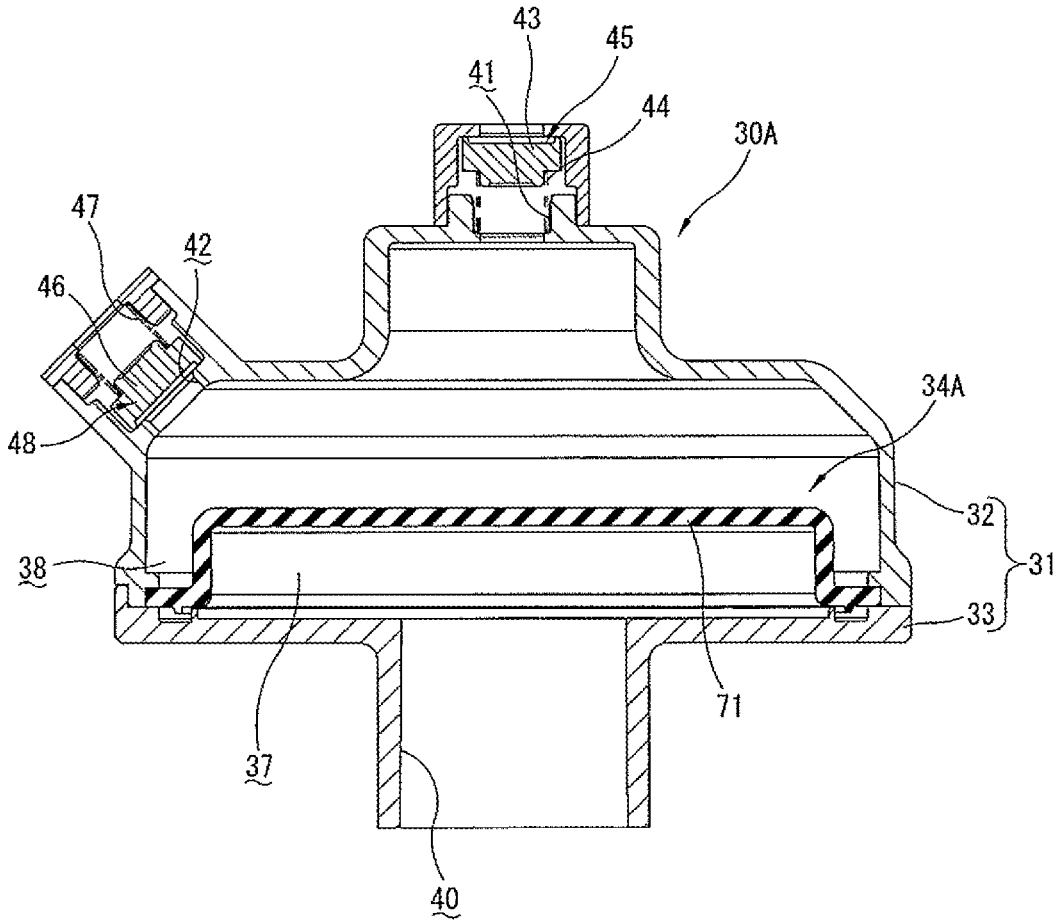
FIG. 11 is a cross-section view of a pulsation pump according to a sixth embodiment of the present invention.
Figure 12:
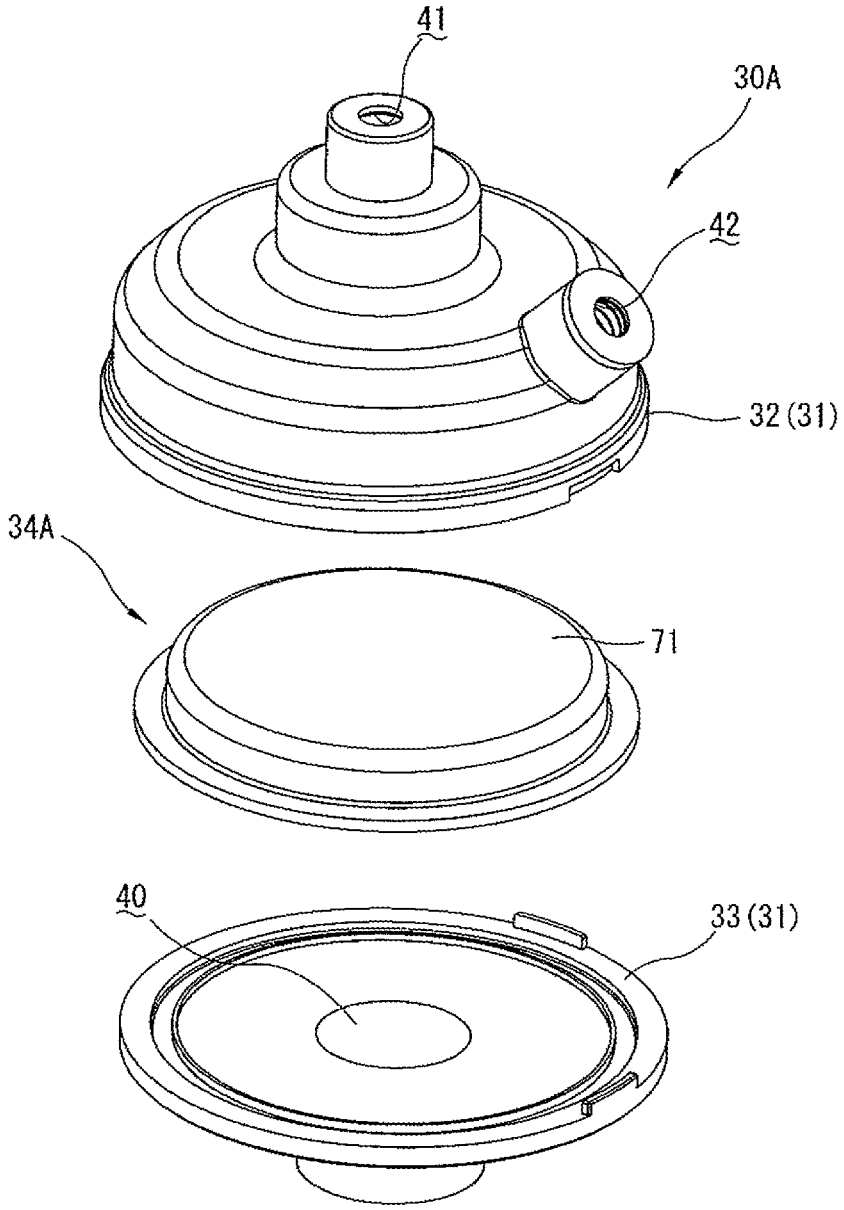
FIG. 12 is an exploded perspective view of the pulsation pump according to the sixth embodiment.

FIG. 11 and FIG. 12 show a pulsation pump 30A according to a sixth embodiment of the present invention. The pulsation pump 30A can be used instead of the pulsation pump 30 according to the first to fifth embodiments. The pulsation pump 30A is different from the pulsation pump 30 of the first embodiment; that is, a peripheral wall of an elastic body 34A is simply cylinder-shaped, not bellows-shaped. Furthermore, it is not required to be deformed in an axial direction, so length of the peripheral wall in the axial direction is formed to be short. Furthermore, a rubber film 71 is provided in a disk-shaped upper wall part of the elastic body 34A.

Also in the pulsation pump 30A of the sixth embodiment, as with the pulsation pump 30 of the first embodiment, when intake pulsation is propagated to the first chamber 37 in the elastic body 34A through the communication passage 40, the rubber film 71 is displaced (vibrated) in the axial direction. Thereby, volume of the first chamber 37 fluctuates. Moreover, the fluctuation of the volume of the first chamber 37 makes volume of the second chamber 38 in the case 31 fluctuate, and thereby pressure in the second chamber 38 fluctuates. Thereby, the gas flows into the first chamber 37 from the suction port 41 through the suction valve 45, and the gas is discharged into the discharge port 42 from the second chamber 38 through the discharge valve 48.

As described above, the present invention has been explained based on the concrete embodiments, but the present invention is not limited to the embodiments and may include various modifications. For example, the elastic body deformed by responding to pressure fluctuation of the first chamber does not necessarily form all of the wall part sealing up the first chamber, and that may form at least a part of the wall part.

Furthermore, in the embodiments, a check valve and a purge control valve (electromagnetic valve) have not been provided in the pulsation purge line and the supercharging purge line. However, the check valve to prevent a backward flow and the purge control valve to adjust a flow rate may be provided.

The entire contents of Japanese Patent Application No. 2016-242867 filed Dec. 15, 2016 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An evaporated fuel processing apparatus for an internal combustion engine comprising:

a canister configured to receive evaporated fuel from a fuel tank to be adsorbed temporarily in the canister, and a purge passage that supplies a purge gas including the evaporated fuel separated from the canister to an intake system of the internal combustion engine therethrough, and a pulsation pump that supplies the purge gas to the intake system by a pumping action responsive to intake pulsation generated in an intake passage of the internal combustion engine, the pulsation pump comprising:

a first chamber, a communication passage directly communicating with the first chamber and the intake passage, an elastic body forming at least a part of a wall part sealing the first chamber and being deformed depending on pressure fluctuation of the first chamber, a second chamber formed so as to surround the elastic body, a suction port provided with a suction valve allowing inflow of gas into the second chamber, and a discharge port provided with a discharge valve allowing outflow of gas from the second chamber.

2. The evaporated fuel processing apparatus for an internal combustion engine as claimed in claim 1, wherein the purge passage is provided with an ejector to carry the purge gas, such that air sucked from the suction port is supplied to the ejector from the discharge port as operation gas.

3. The evaporated fuel processing apparatus for an internal combustion engine as claimed in claim 1, wherein the suction port is connected to the purge passage, such that the purge gas discharged from the discharge port is supplied to the intake system.

4. The evaporated fuel processing apparatus for an internal combustion engine as claimed in claim 1, wherein the apparatus comprises a compressor of a supercharger to pressurize an intake air supplied to the internal combustion engine.

5. The evaporated fuel processing apparatus for an internal combustion engine as claimed in claim 1, wherein the purge passage includes a main purge line and a pulsation purge line, each of which is connected to the intake passage.

* * * * *